US011521524B2

(12) United States Patent
Gomora

(10) Patent No.: US 11,521,524 B2
(45) Date of Patent: Dec. 6, 2022

(54) ADJUSTABLE BASE HOLDER FOR GARDEN FLAGPOLES

(71) Applicant: Tracey Maria Gomora, Franktown, CO (US)

(72) Inventor: Tracey Maria Gomora, Franktown, CO (US)

( * ) Notice: Subject to any disclaimer, the term of this patent is extended or adjusted under 35 U.S.C. 154(b) by 0 days.

(21) Appl. No.: 17/301,501

(22) Filed: Apr. 5, 2021

(65) Prior Publication Data

US 2022/0319362 A1 Oct. 6, 2022

(51) Int. Cl.
*G09F 17/00* (2006.01)

(52) U.S. Cl.
CPC ..... *G09F 17/00* (2013.01); *G09F 2017/0066* (2013.01)

(58) Field of Classification Search
CPC ..... G09F 17/00; G09F 2017/0066
See application file for complete search history.

(56) References Cited

U.S. PATENT DOCUMENTS 232,461 A * 9/1880 Coolbaugh ..... H01Q 1/1221 248/539
859,781 A * 7/1907 Roebuck ..... A47B 57/04 108/1
2,227,152 A * 12/1940 Pidot ..... A47F 11/00 40/607.1
2,260,787 A * 10/1941 Nichols ..... G09F 17/00 248/513
3,202,909 A * 8/1965 Chandler ..... G01V 3/107 324/329
3,302,909 A * 2/1967 Glassman ..... A47G 33/12 248/524
5,320,322 A * 6/1994 Williams ..... G09F 17/00 248/514
5,438,789 A * 8/1995 Emory ..... A01K 97/10 248/514
5,588,630 A 12/1996 Chen-Chao
5,694,733 A 12/1997 Gallimore
6,811,132 B1 * 11/2004 Ferdinand ..... F16M 13/02 248/538
9,580,927 B1 * 2/2017 Heil ..... E04H 13/003

(Continued)

FOREIGN PATENT DOCUMENTS

CH 326090 A * 12/1957
CN 213869196 U * 8/2021
WO WO-2009024948 A2 * 2/2009 ..... E04H 12/2238

OTHER PUBLICATIONS

Translation of:CN 213869196 U, Li, "Garden Flag Platform", 2021 (Year: 2021).*

(Continued)

*Primary Examiner* — Nimeshkumar D Patel
*Assistant Examiner* — Tania Courson

(57) ABSTRACT

An adjustable base to hold garden flag banner poles includes a base and two cylinders with holes for the two legs of the garden flag pole, the legs held in place with set screws on the side of the cylinders, the cylinders sit in a slot within the base, are attached to the base with two carriage bolts on the bottom of the base, one for each cylinder, the slot within the base allows the each cylinder holder of a leg components to slide to fit the multiple distances between flag pole legs.

3 Claims, 6 Drawing Sheets

(56) References Cited

U.S. PATENT DOCUMENTS

| | | | | |
|---|---|---|---|---|
| 2005/0167552 | A1* | 8/2005 | Tourtellotte | E01F 9/692 248/158 |
| 2009/0013921 | A1* | 1/2009 | Yun | G09F 17/00 206/223 |
| 2011/0094436 | A1 | 4/2011 | Fivgas | |

OTHER PUBLICATIONS

Translation of: CH 326090, Hunkeler, "Flagpole Holder" (Year: 1958).*

* cited by examiner

ADJUSTABLE BASE HOLDER FOR GARDEN FLAGPOLES

FIELD OF THE INVENTION

The present invention relates to an adjustable base to hold flag banners. More particularly, the present invention is directed to an adjustable base which can be adjusted to different distances between the two legs, and different size thicknesses of the legs.

BACKGROUND OF THE INVENTION

In general, many kinds of garden flag banners poles are pushed into the ground. The garden flag banner typically have on major pole with a leg, and near the bottom of the pole there is rod, attached at a 90 degree angle with a leg going down at a 90 degree angle to provide additional upright support. With two legs in the ground the garden flag pole banners have some stability. But the current solution doesn't work on windy days, or where no ground is available or when banners need to be on a hard surface, or when the ground is very hard.

PRIOIR ART PATENTS

One patent U.S. Pat. No. 5,588,630A, Chen-Chao, 1996 addresses he need to have flag pole banners tilt at an angle, but doesn't address the need for a better base to hold the garden flag pole banner in place when conditions are not ideal.

OBJECTS OF THE INVENTION

It is the main object of this invention to provide an garden adjustable flag pole base to allow garden flag poles to be used when ground conditions are not ideal.

The second object of this invention is to provide an adjustable garden flag pole base that can easily adjust to the varying distances between the garden flag pole's main leg, and the second leg, which comes at a 90 degree angle down for a rod that is attached at a 90 degree angle to the main garden flag pole.

SUMMARY OF THE INVENTION

According to a broad aspect of the present invention, there comprises an adjustable base with following features:

a base;

a slot in the base that extends from the center of the base to with a width of 12 to 18 inches;

two cylinders that sit in the slot, the cylinders each held in place by carriage bolts, but also able to move, with the carriage bolt loosened to different locations along the slot;

tightening screws on the top of each cylinder to hold the flag pole in place.

PART NUMBER DESCRIPTIONS

1. Base
2. Slot in base
3. Cylinders for holding flag pole legs
4. Carriage bolts
5. Banner pole with legs
6. Banner
7. Tightening screws on top of cylinder for holding banner pole legs in place.

DETAILED DESCRIPTION

Figure 1:
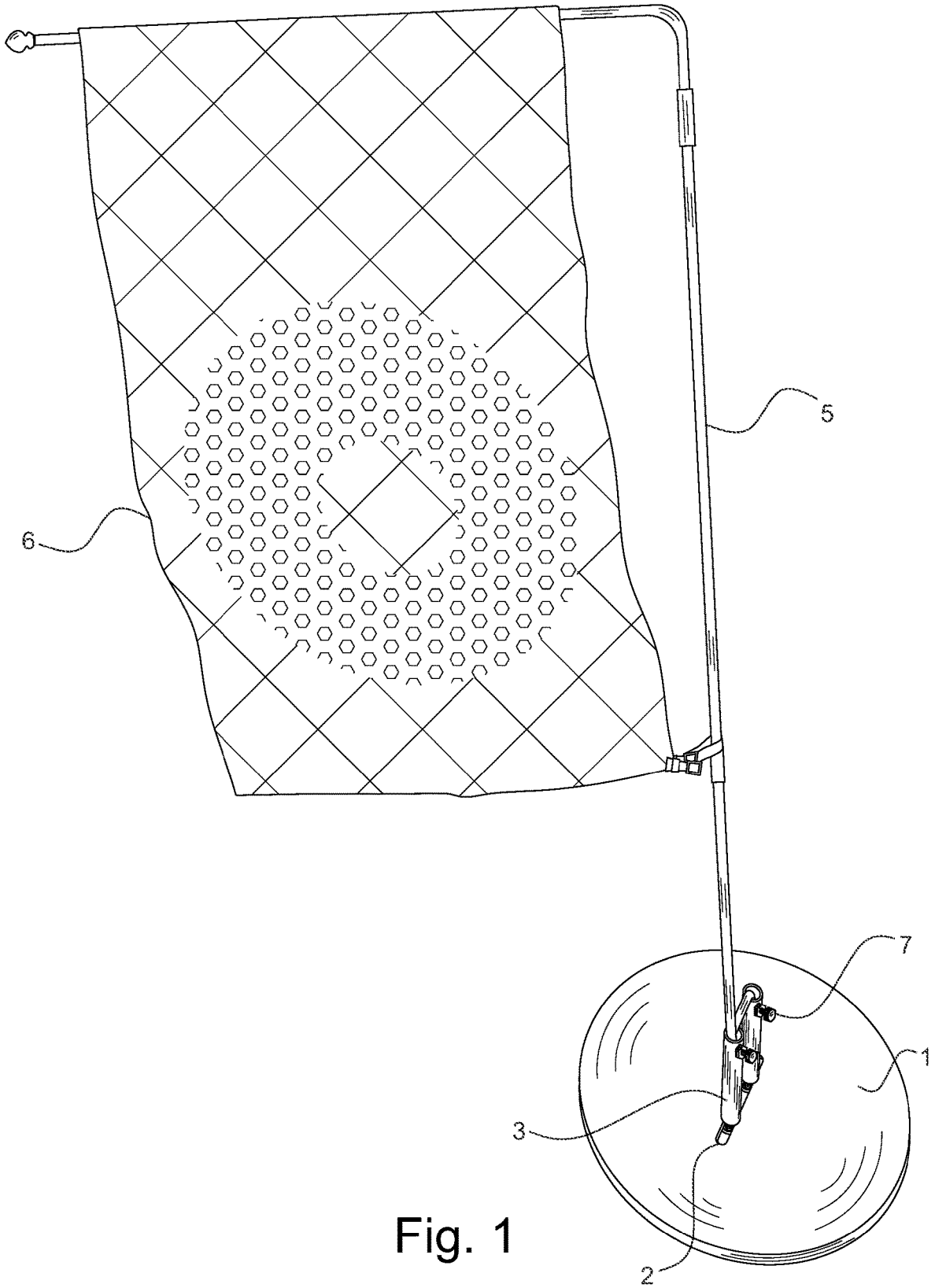
FIG. 1. View of adjustable base holder holding a flag pole for banners with a banner, view of the product in use.

FIG. 1 shows the adjustable base 1 for banner poles as it is used. The banner 6 is held in position by the banner pole 5, which is held in place in two cylinders 3 which have been positioned in the slot 2 so that they fit the banner pole's 5 leg positions. The banner pole legs are held tightly in the cylinders by tightening screws 7 which are near the top of the cylinders 3.

Figure 2:
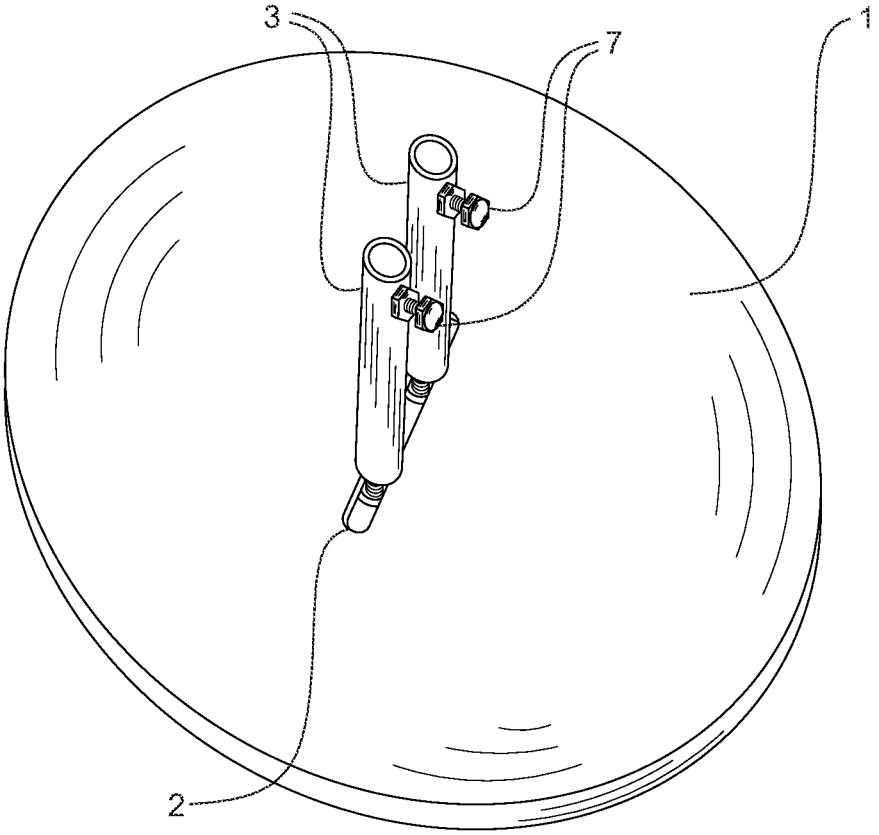
FIG. 2. View of the adjustable base holder for a ¾ top views, with the cylinders positioned to hold a garden flag pole.

FIG. 2 shows a ¾ view of the adjustable base holder, 2 showing the slot that the cylinders 3 move in to be positioned to hold the banner pole legs 5, and the tightening screws 7.

Figure 3:
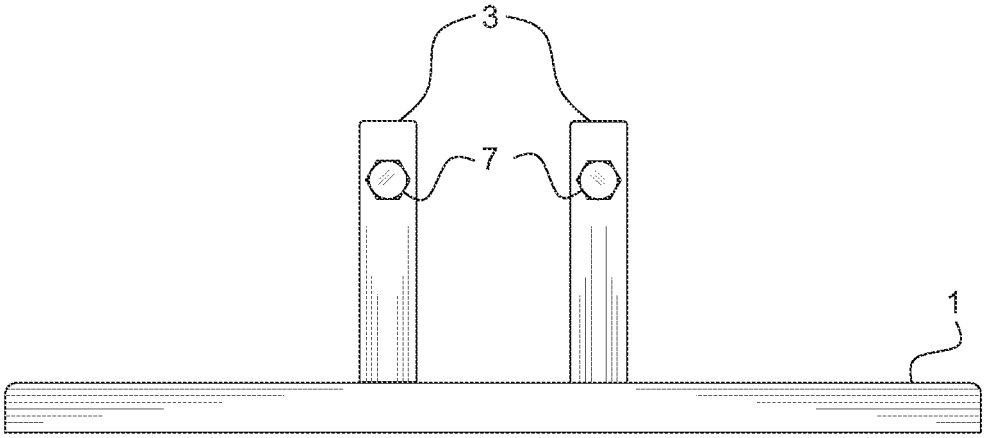
FIG. 3. Ground level front view of the adjustable base holder showing the tightening screws on the cylinders, with the front view defined as the view where the tightening screws can be seen.
Figure 4:
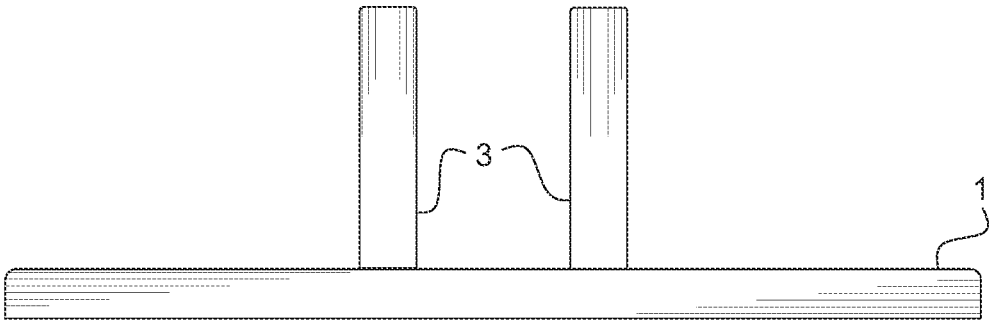
FIG. 4. Ground level back view of the adjustable base holder, with the back view defined as the view where the tightening screws cannot be seen.

FIG. 3 and FIG. 4 show ground views of the adjustable base 1, with FIG. 3 showing a front view of the adjustable base, where the tightening screws can be seen facing forward and FIG. 4 showing a back view of the adjustable base where the tightening screws cannot be seen.

Figure 5:
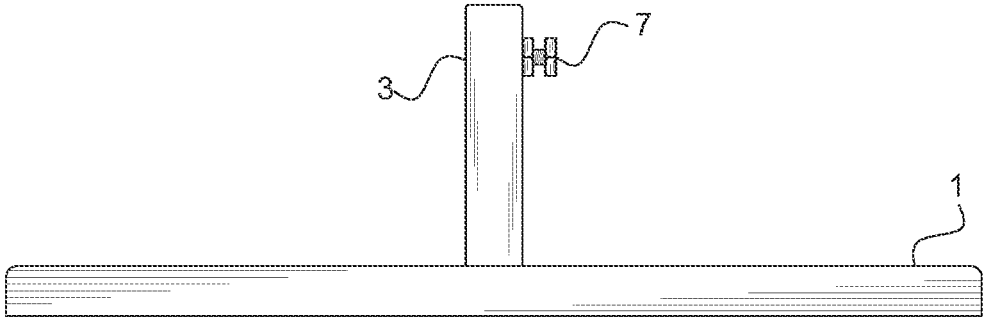
FIG. 5. Right side view of the adjustable base holder.
Figure 6:
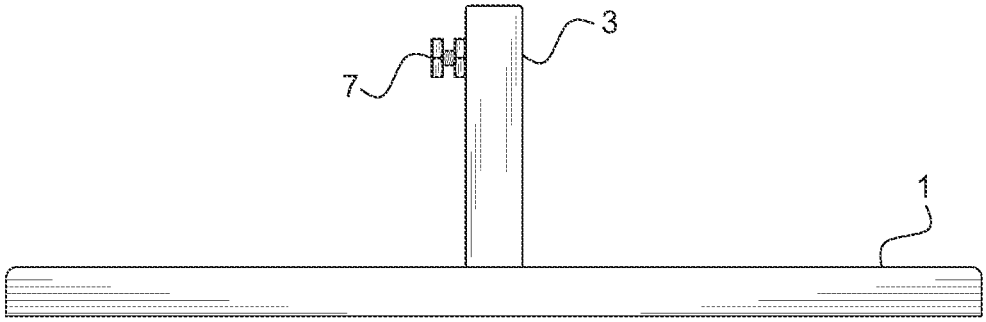
FIG. 6. Left side view of the adjustable base holder.

FIG. 5 and FIG. 6 show a ground level side view of the adjustable base holder 1, with FIG. 5 showing a side views with the front of the base facing right in the illustration and FIG. 6 shows a side view if the adjustable base 1 facing left in the illustration. The tightening screws in FIG. 5 face to the front, or right side of the illustration, and the tightening screws face left in the illustration as the right side of the illustration is the back of the base.

Figure 7:
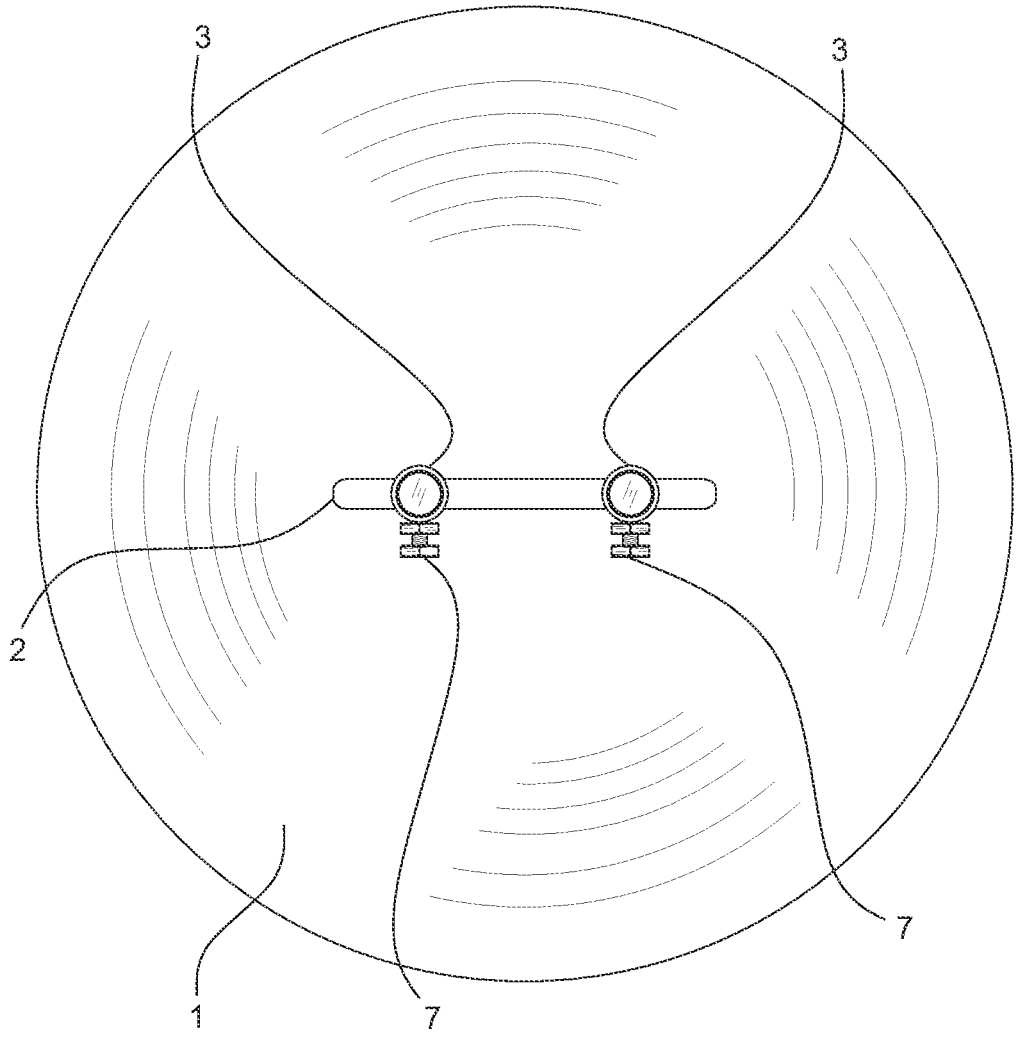
FIG. 7. Top view of the adjustable base holder.

FIG. 7 shows the base 1 from a top view, illustrating the slot 2, that the cylinders can move back and forth in, the cylinders 3 and the tightening screws 7.

Figure 8:
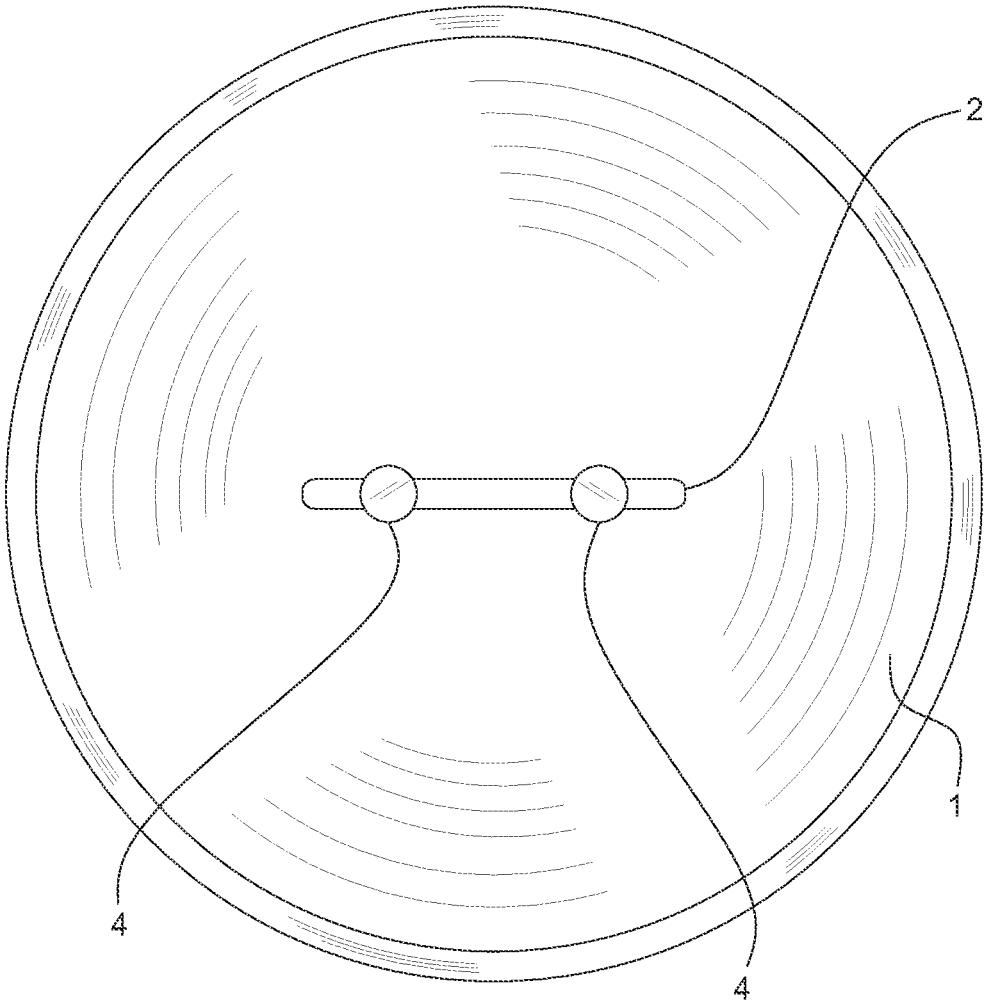
FIG. 8. Bottom view of the adjustable base holder.

FIG. 8 shows the bottom of the base 1, with the slot 2 for moving the cylinders 3 into alignment position and the carriage bolts 7 for holding the cylinders in place once they are properly aligned.

I claim:

1. An adjustable base holder for a garden flag poles comprising;

a base;

a slot in the base that extends from the center of the base to with a width of 12 to 18 inches;

two cylinders that sit in the slot;

holding devices that hold the cylinders in place in the slot;

tightening devices on the top of each cylinder; whereby the cylinders, once the holding devices are loosened can move in the slot so they align with the width separating the two legs on the garden flag pole, and after alignment can be held in place with the holding devices, and two legs on the garden flag pole can be held tightly in the cylinders with the use of tightening devices near the top of the cylinders.

2. The adjustable base holder for the garden flag pole of claim 1 where the holding devices for the cylinders to the base are carriage bolts.

3. The adjustable base holder for the garden flag pole of claim 1 where the tightening devices near the top of the carriage bolts are tightening screws.

* * * * *